US011098888B1

(12) United States Patent
Walker

(10) Patent No.: US 11,098,888 B1
(45) Date of Patent: Aug. 24, 2021

(54) CHARGER PLATE WITH INTERCHANGEABLE DÉCOR RING

(71) Applicant: Kimberly Renee Walker, Sicklerville, NJ (US)

(72) Inventor: Kimberly Renee Walker, Sicklerville, NJ (US)

( * ) Notice: Subject to any disclaimer, the term of this patent is extended or adjusted under 35 U.S.C. 154(b) by 0 days.

(21) Appl. No.: 16/563,910

(22) Filed: Sep. 8, 2019

(51) Int. Cl.

| | |
|---|---|
| ***A47G 19/02*** | (2006.01) |
| ***F21V 33/00*** | (2006.01) |
| *F21Y 115/10* | (2016.01) |
| *F21W 121/00* | (2006.01) |

(52) U.S. Cl.
CPC ..... *F21V 33/0036* (2013.01); *A47G 19/02* (2013.01); *F21W 2121/00* (2013.01); *F21Y 2115/10* (2016.08)

(58) Field of Classification Search
None
See application file for complete search history.

(56) References Cited

U.S. PATENT DOCUMENTS

| | | | | |
|---|---|---|---|---|
| 4,640,033 | A * | 2/1987 | Bulger | G09B 19/0076 40/324 |
| 5,319,531 | A * | 6/1994 | Kutnyak | A63H 33/18 362/184 |
| 5,430,628 | A * | 7/1995 | Saunders | A47G 23/06 362/154 |
| 6,547,623 | B1 * | 4/2003 | Collado | A63H 33/18 446/46 |
| 8,444,288 | B1 * | 5/2013 | Leal | F21V 33/0036 362/157 |
| 8,769,849 | B1 * | 7/2014 | McCombs | A47G 19/025 40/324 |
| 2012/0106158 | A1 * | 5/2012 | Vaessen | A47G 23/06 362/253 |
| 2015/0245723 | A1 * | 9/2015 | Alexander | F25B 21/04 99/483 |

* cited by examiner

*Primary Examiner* — Elmito Breval
(74) *Attorney, Agent, or Firm* — Changi Wu; Changi Wu Law Office

(57) ABSTRACT

A charger plate apparatus comprises a charger plate, an interchangeable decorative ring, and a ridge formed on the charger plate, wherein the interchangeable decorative ring can be secured by the ridge on the charger plate.

7 Claims, 5 Drawing Sheets

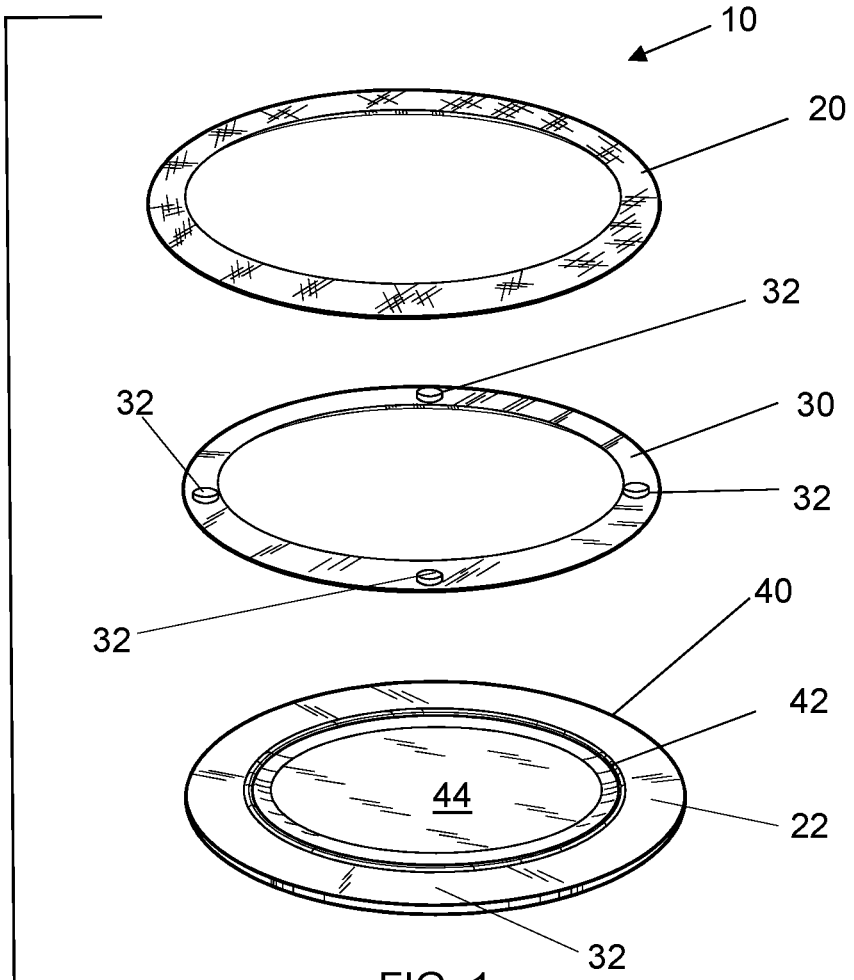
FIG. 1
(Amended)

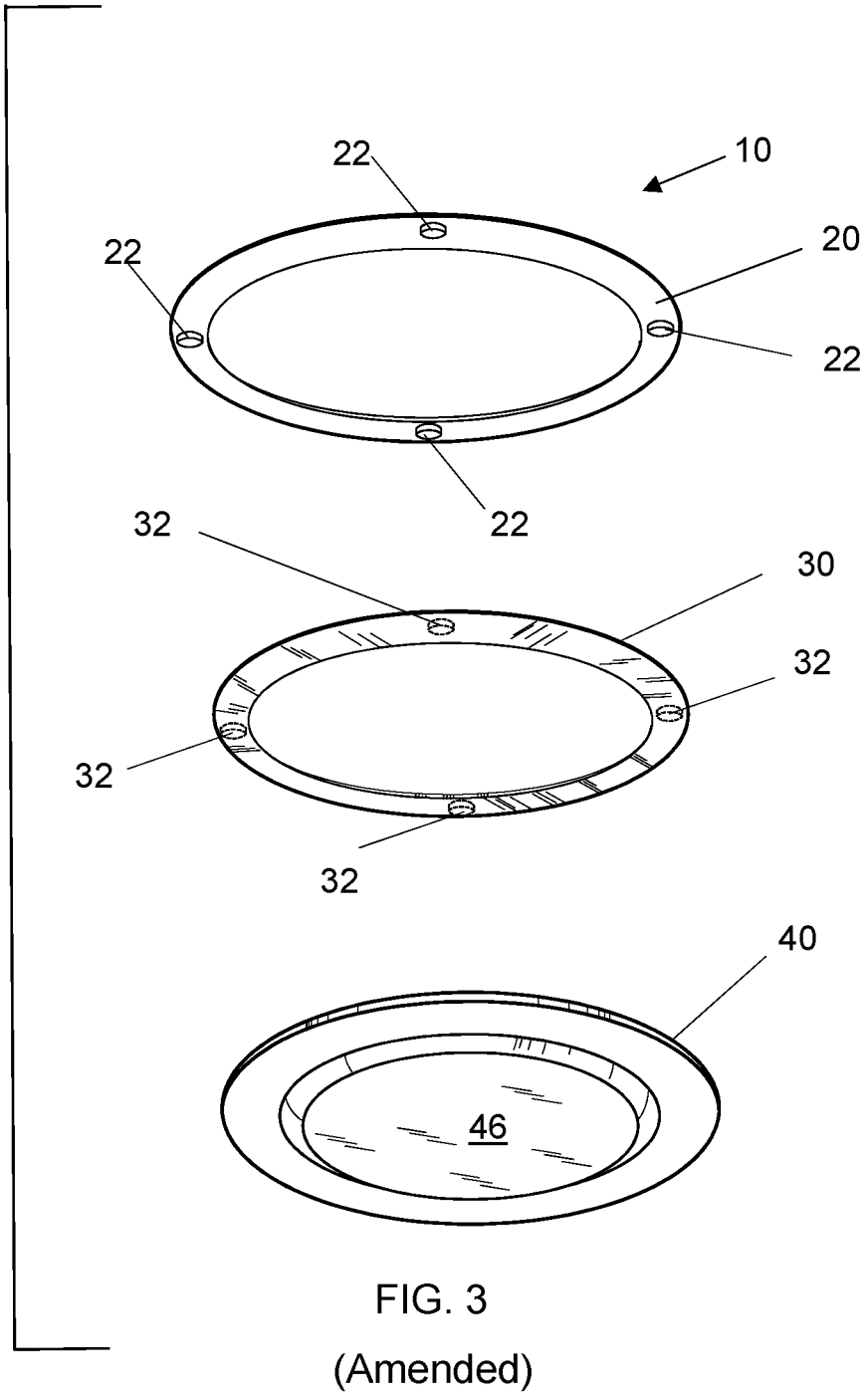
FIG. 3
(Amended)

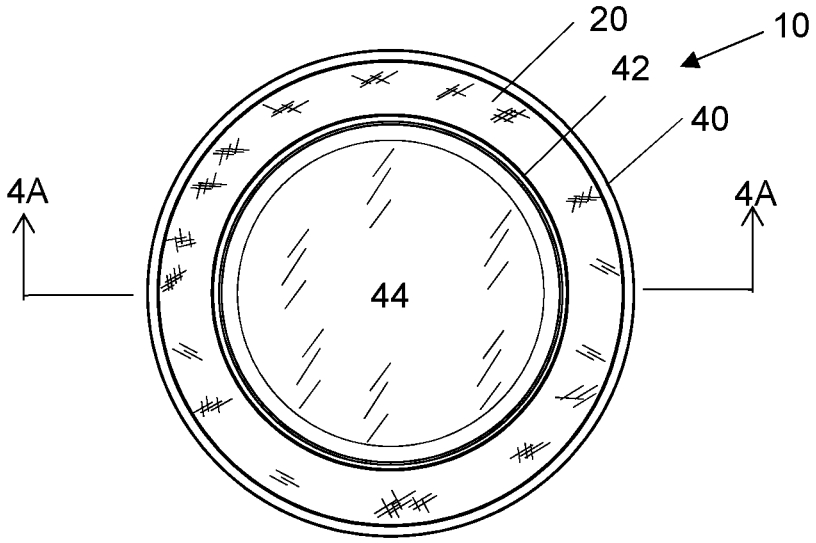
FIG. 4
(Amended)

CHARGER PLATE WITH INTERCHANGEABLE DÉCOR RING

CROSS-REFERENCE RELATED TO RELATED APPLICATIONS

Not Available

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND

"Charger plates," are well known in the Table Décor industry and act as a decorative base plate to accompany fine tableware. Charger plates are usually larger than most common dinner plates and add elegance and etiquette to table settings and can be found in a variety of materials, from traditional china to metal, wood, glass, plastic, and pearl to hold china. Despite the utilitarian benefits of the traditional charger plate, it limits in aesthetic appeal.

BRIEF SUMMARY OF THE INVENTION

This Brief Summary is included so as to introduce, in an abbreviated form, various topics to be elaborated upon below in the Detailed Description. This Brief Summary is not intended to identify key or essential aspects of the claimed invention. This Brief Summary is similarly not intended for use as an aid in determining the scope of the claims.

This invention is directed to a charger plate apparatus that comprises a charger plate, an interchangeable decorative ring, and a ridge formed on the charger plate, wherein the interchangeable decorative ring can be secured by the ridge on the charger plate. The benefit of the invention relates generally to optimizing the décor function of a charger plate for table settings and more particularly to charger plates having a removable decorative ring positioned along the circumference of the tray. The charger plate with an interchangeable decorative ring modifies the appearance of traditional décor plates while allowing the same tableware to be used for more than one occasion or event. Such adaptability is particularly desirable as it relates to changing seasons and specific holidays. Indeed, an interchangeable decorative ring having ornamentation that may be selectively modified or interchanged to correspond to a new season or holiday saves money on changing tableware and accessories typically found stored in garages and basements after season changes. Moreover, the functional benefits of the charger plate with interchangeable decorative ring are often desired regardless of any particular occasion. Charger plate with interchangeable decorative Ring can be used to dress up special events like parties or weddings and enable table décor to adapt to everyday basic table settings. Charger plate with interchangeable decorative ring provides Do-it-yourself (DIY) decorator more affordable and fun options to enhance room décor.

BRIEF DESCRIPTION OF THE DRAWINGS

It should be understood that the drawings are merely representative, are not necessarily drawn to scale, and are not intended to limit the subject matter of this application.

FIG. 1 is a perspective (from top), exploded view of one of the preferred embodiment of the invention.

FIG. 3 is a perspective (from bottom), exploded view of one of the preferred embodiment of the invention.

FIG. 4 is a top view of one of the preferred embodiment of the invention.

DETAILED DESCRIPTION

Figure 2:
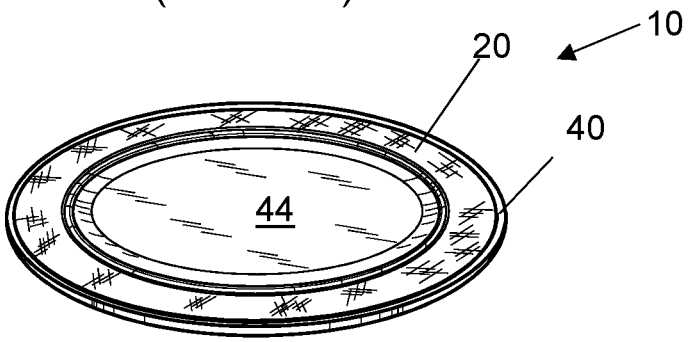
FIG. 2 is a perspective view (from top) of one preferred embodiment of the invention.
Figure 4A:
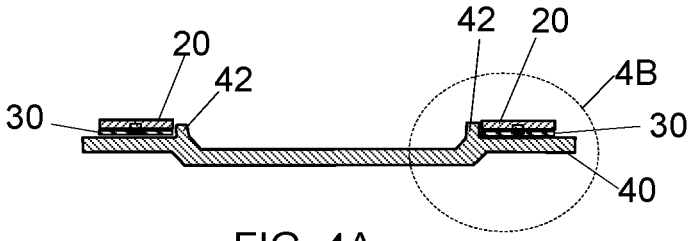
FIG. 4A is a sectional view of one of the preferred embodiment of the invention.
Figure 4B:
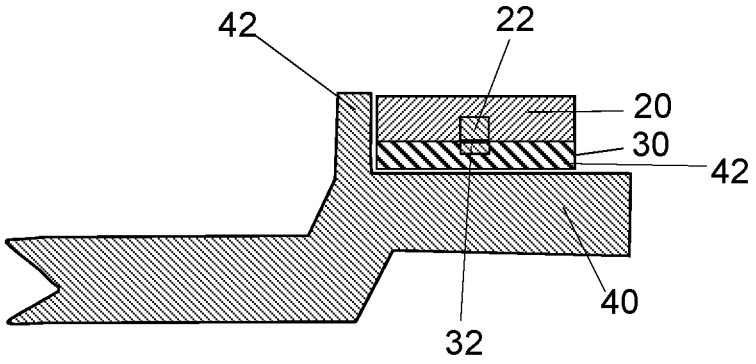
FIG. 4B is a partial, sectional view of one of the preferred embodiment of the invention.

Before the present invention is described in greater detail, it is to be understood that this invention is not limited to particular embodiments described, and as such may, of course, vary. It is also to be understood that the terminology used herein is for the purpose of describing particular embodiments only, and is not intended to be limiting since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Other than in the embodiment or example, or where indicated otherwise, all numbers indicating ingredient quantities and/or reaction conditions are to be understood as being modified in every instance by the word "about," which means the ingredient quantities or reaction conditions are within 10 percent to 15 percent of the indicated value.

Unless defined otherwise, all terms used herein have the same meaning as commonly understood by one of ordinary skill in the art to which this invention belongs. Although any methods and materials similar or equivalent to those described herein can be used in the practice or testing of the present invention, some potential and exemplary methods and materials may now be described. Any and all publications mentioned herein are incorporated herein by reference to disclose and describe the methods and/or materials in connection with which the publications are cited. It is understood that the present disclosure supersedes any disclosure of an incorporated publication to the extent there is a contradiction.

It must be noted that as used herein and in the appended claims, the singular forms "a", "an", and "the" may also include the plural referents unless the context clearly dictates otherwise.

It is further noted that the claims may be drafted to exclude any element that may be optional. As such, this statement is intended to serve as antecedent basis for use of such exclusive terminology as "solely", "only" and the like in connection with the recitation of claim elements, or the use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention.

As shown in FIG. 1, FIG. 2, and FIG. 3, FIG. 4, FIG. 4A, and FIG. 4B, a charger plate apparatus 10 comprises a charger plate 40, an interchangeable decorative ring 20, and a ridge 42 formed on the charger plate 40, wherein the interchangeable decorative ring 20 can be secured by the ridge 42 on the charger plate 40. The charger plate 40 has a top surface 44 and bottom surface 46. A protective membrane 30 configured to be below the interchangeable decorative ring 20, a first set of magnets 22 attached on or embedded in the interchangeable decorative ring 20, and a second set of magnets 32 attached on or embedded in the protective membrane 30, wherein the protective membrane 30 can be attached or detached to the interchangeable decorative ring 20 by the first set of magnets 22 and the second set of magnets 32.

Figure 5:
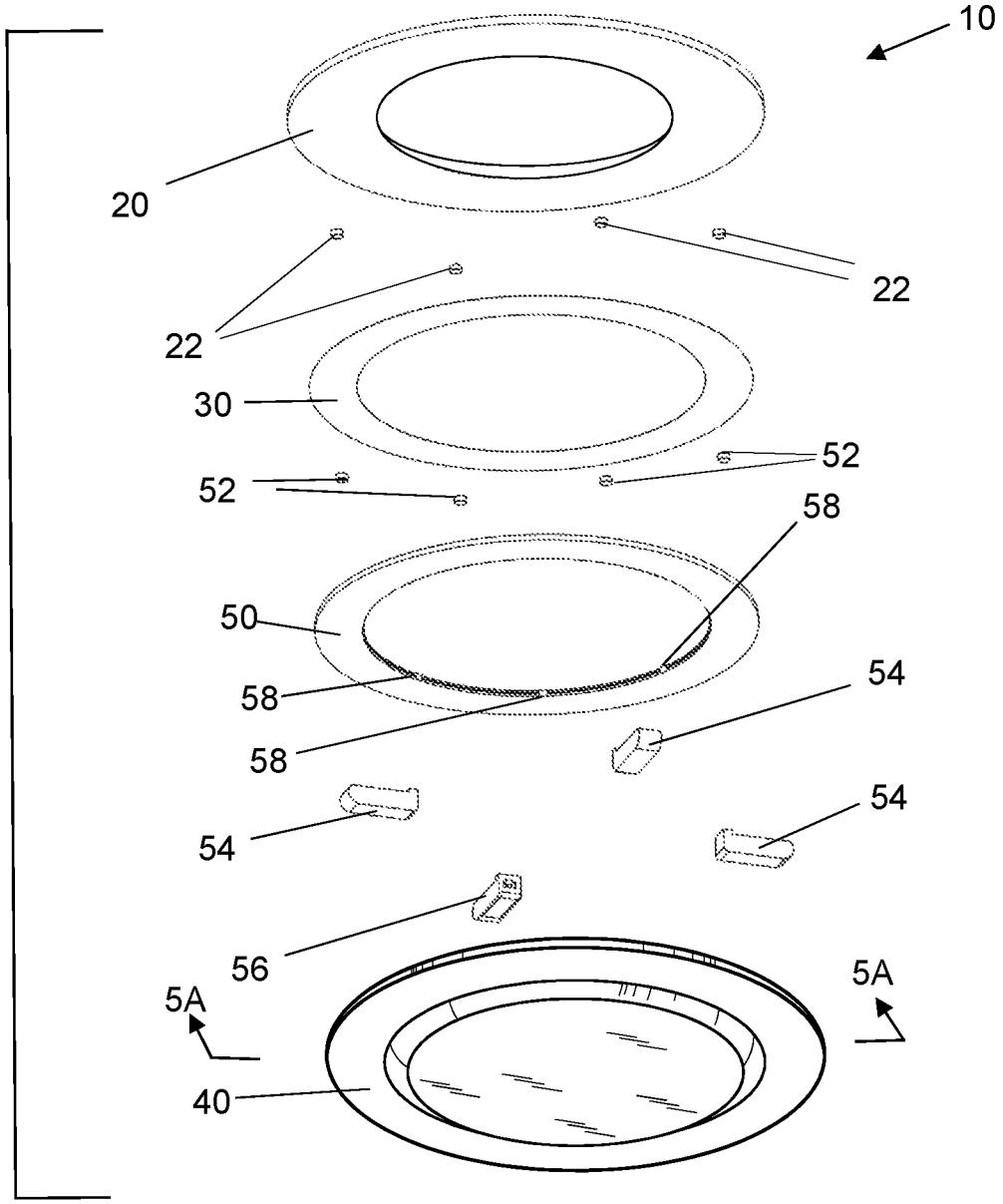
FIG. 5 is a perspective (from bottom), exploded view of one of the preferred embodiment of the invention.
Figure 5A:
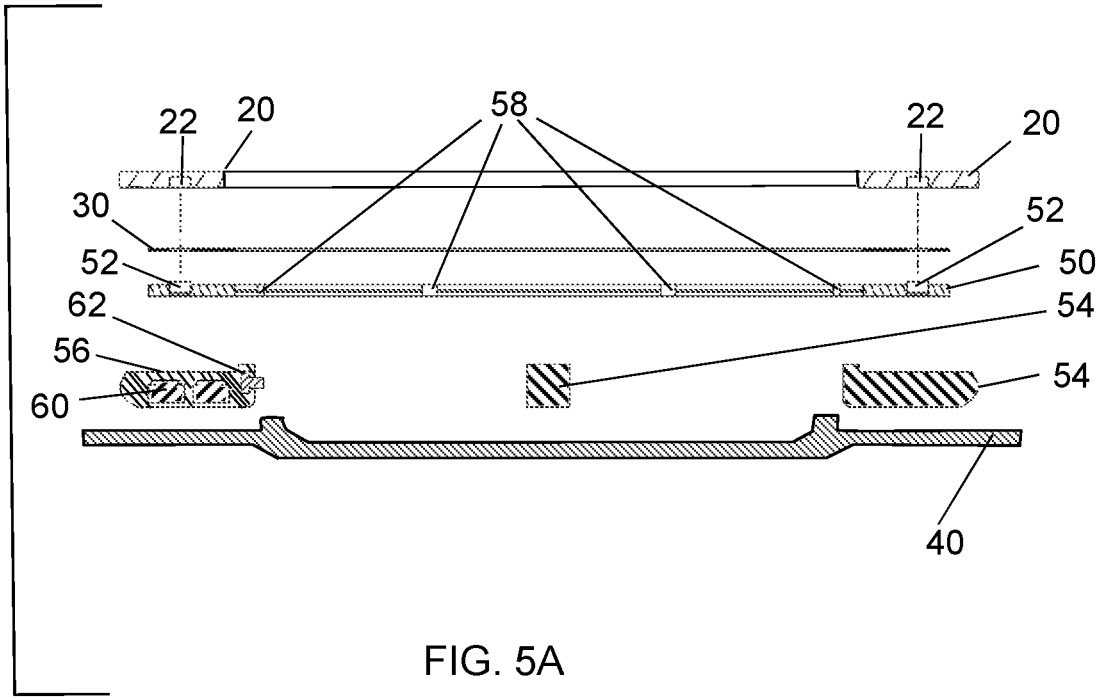
FIG. 5A is a sectional, exploded view of one of the preferred embodiment of the invention.

As shown in FIG. 5, and FIG. 5A, in one embodiment, the charger plate apparatus 10 further comprises an illumination ring 50 configured to be above the charger plate 40, a plurality of light-emitting diodes 58 configured on the illumination ring 50, an electrical power source 56 connected to the plurality of light-emitting diodes 58, an electronic controller 62 to control electrical power source 56, a protective membrane 30 configured to be below the interchangeable decorative ring 20 and above the illumination ring 50, a first set of magnets 22 attached on or embedded in the interchangeable decorative ring 20, and a second set of magnets 52 attached on or embedded in the illumination ring 50, wherein the illumination ring 50 can be attached or detached to the interchangeable decorative ring 20 by the first set of magnets 22 and the second set of magnets 52. Optionally, the illumination ring 50 may have a plurality of support members 54 configured below the illumination ring 50 and are to support the illumination ring 50 on the charger plate 40. The support members 54 can be made of plastic or suitable material. The support members 54 can be solid or hollow as long as structurally sound. One of the plurality of support members 54 are configured to be the electrical power source 56, which comprises at least one battery 60. In another embodiment, the illumination ring 50 is made of fluorescent material to be a light source.

In the preferred embodiment, magnets are used for the attachment of the interchangeable decorative ring, the protective membrane, and the illumination ring. However, other attachment methods, such as hook and loop fasteners, adhesives, static clings, latches, buckles, wedges, sockets, and clamps, pins, buttons, joints, and other methods that a person having ordinary skill in the art would be able to appreciate and practice.

As appreciated by a person having ordinary skill in the art, more functions can be added to the interchangeable decorative ring, such as but not limited to illumination method other than light-emitting diode, information display devices, communication devices, identification devices, ornamental devices, heating devices, cooking devices, fragrance devices, flavor devices, and other functional devices that can be added on or integrated with the decorative ring.

The material of the interchangeable decorative ring, the protective membrane, or the illumination ring may be plastic, porcelain, metal, alloy, glass, fabric, wood, plants, fluorescent material, natural or manmade material, or combination thereof.

What claimed is:

1. A charger plate apparatus comprising
- a charger plate,
- an interchangeable decorative ring, and
- a ridge formed on the charger plate,
- wherein the interchangeable decorative ring can be secured by the ridge on the charger plate,
- a protective membrane configured to be below the interchangeable decorative ring,
- a first set of magnets attached on or embedded in the interchangeable decorative ring, and
- a second set of magnets attached on or embedded in the protective membrane, wherein the protective membrane can be attached or detached to the interchangeable decorative ring by the first set of magnets and the second set of magnets.

2. The charger plate apparatus of claim 1, further comprising
- an illumination ring configured to be above the charger plate, a plurality of light-emitting diodes configured on the illumination ring,
- an electrical power source connected to the plurality of light-emitting diodes,
- an electronic controller to control the electrical power source.

3. The charger plate apparatus of claim 2, further comprising a plurality of support members under the illumination ring, wherein the plurality of support members support the illumination ring on the charger plate.

4. The charger plate apparatus of claim 2, wherein the illumination ring is made of fluorescent materials to be a light source.

5. A charger plate apparatus comprising
- a charger plate,
- an interchangeable decorative ring, and
- a ridge formed on the charger plate,
- wherein the interchangeable decorative ring can be secured by the ridge on the charger plate,
- an illumination ring configured to be above the charger plate, a plurality of light-emitting diodes configured on the illumination ring,
- an electrical power source connected to the plurality of light-emitting diodes,
- an electronic controller to control the electrical power source,
- a protective membrane configured to be below the interchangeable decorative ring and above the illumination ring,
- a first set of magnets attached on or embedded in the interchangeable decorative ring, and
- a second set of magnets attached on or embedded in the illumination ring, wherein the illumination ring can be attached or detached to the interchangeable decorative ring by the first set of magnets and the second set of magnets.

6. The charger plate apparatus of claim 5, further comprising a plurality of support members under the illumination ring, wherein the plurality of support members support the illumination ring on the charger plate.

7. The charger plate apparatus of claim 5, wherein the illumination ring is made of fluorescent materials to be a light source.

* * * * *